US007650969B2

(12) United States Patent
Monzon et al.

(10) Patent No.: US 7,650,969 B2
(45) Date of Patent: Jan. 26, 2010

(54) SAFETY DEVICE FOR USE IN AN ELEVATOR SYSTEM INCLUDING A TRIGGERING MEMBER FOR ACTIVATING A SAFETY BRAKE

(75) Inventors: Andres Monzon, Madrid (ES); Fernando Del Rio, Madrid (ES); Antonio de Miguel, Madrid (ES); Jose Caballero, Madrid (ES); Elviro Lorenzo, Madrid (ES); Francisco Manuel Cervera Morales, Madrid (ES)

(73) Assignee: Otis Elevator Company, Farmington, CT (US)

( * ) Notice: Subject to any disclaimer, the term of this patent is extended or adjusted under 35 U.S.C. 154(b) by 441 days.

(21) Appl. No.: 11/576,273

(22) PCT Filed: Dec. 3, 2004

(86) PCT No.: PCT/US2004/040690

§ 371 (c)(1),
(2), (4) Date: Mar. 29, 2007

(87) PCT Pub. No.: WO2006/062503

PCT Pub. Date: Jun. 15, 2006

(65) Prior Publication Data

US 2007/0289820 A1 Dec. 20, 2007

(51) Int. Cl.
*B66B 1/26* (2006.01)

(52) U.S. Cl. ..... 187/300; 187/360

(58) Field of Classification Search ..... 187/300, 187/301, 360, 370, 391, 393, 287–289, 316, 187/317, 414, 313; 49/25, 26, 28; 318/466–469, 318/280–286

See application file for complete search history.

(56) References Cited

U.S. PATENT DOCUMENTS

| | | | |
|---|---|---|---|
| 503,486 | A | 8/1893 | Labatt |
| 1,069,070 | A | 7/1913 | Magnuson |
| 1,182,240 | A | 5/1916 | Bemies |
| 1,223,819 | A | 4/1917 | Mitchell |
| 2,765,874 | A | 10/1956 | Staley |
| 3,211,258 | A | 10/1965 | Dickmann |
| 3,674,113 | A | 7/1972 | Richmon |

(Continued)

FOREIGN PATENT DOCUMENTS

| | | | |
|---|---|---|---|
| EP | 0985623 | A2 | 3/2000 |

(Continued)

*Primary Examiner*—Jonathan Salata
(74) *Attorney, Agent, or Firm*—Carlson, Gaskey & Olds PC

(57) ABSTRACT

An elevator system includes a safety device strategically positioned within a hoistway to provide overhead or under car clearance during an inspection procedure, for example. An example safety device includes a triggering member that is selectively moved into a stopping position to engage a safety brake for preventing movement of an elevator car beyond a selected vertical position. The triggering member is selectively moveable in an automated manner between a retracted position and a stopping position. When the triggering member is in a retracted position, it has no effect on normal elevator system operation. When the triggering member is in the stopping position, it provides for maintaining adequate clearance between an elevator car assembly and another surface or structure within an elevator hoistway.

25 Claims, 4 Drawing Sheets

U.S. PATENT DOCUMENTS

| | | | | |
|---|---|---|---|---|
| 4,832,158 | A | 5/1989 | Farrar et al. | |
| 4,923,055 | A | 5/1990 | Holland | |
| 5,002,158 | A | 3/1991 | Ericson et al. | |
| 5,321,216 | A | 6/1994 | Jamieson et al. | |
| 5,773,771 | A * | 6/1998 | Chatham | 187/282 |
| 6,138,798 | A * | 10/2000 | Macuga | 187/294 |
| 6,173,813 | B1 * | 1/2001 | Rebillard et al. | 187/287 |
| 6,202,797 | B1 * | 3/2001 | Skolnick et al. | 187/317 |
| 6,223,861 | B1 * | 5/2001 | Sansevero | 187/316 |
| 7,237,655 | B2 * | 7/2007 | Kocher | 187/314 |
| 7,267,201 | B2 * | 9/2007 | Ito | 187/372 |
| 7,278,517 | B2 * | 10/2007 | Gut | 187/300 |
| 2004/0222046 | A1 | 11/2004 | Gut | |

FOREIGN PATENT DOCUMENTS

| | | | |
|---|---|---|---|
| GB | 197790 | | 5/1923 |
| GB | 252122 | | 9/1926 |
| JP | 1444641 | | 8/1976 |
| JP | 8133631 | | 5/1996 |
| WO | 03008317 | A1 | 1/2003 |
| WO | 2006035264 | A1 | 4/2006 |
| WO | WO 2008004021 | A1 * | 1/2008 |

* cited by examiner

SAFETY DEVICE FOR USE IN AN ELEVATOR SYSTEM INCLUDING A TRIGGERING MEMBER FOR ACTIVATING A SAFETY BRAKE

FIELD OF THE INVENTION

This invention generally relates to elevator systems. More particularly, this invention relates to a safety device for use in an elevator system.

DESCRIPTION OF THE RELATED ART

Contemporary elevator systems include an elevator car that moves within a hoistway between different levels in a building, for example. Various safety considerations are taken into account and various devices are provided for such considerations.

For example, some elevator systems allow the elevator car to move within the hoistway such that there is limited overhead clearance when the car is in its highest position. This low-overhead feature of such systems presents a challenge during maintenance procedures, for example. In some instances, a mechanic or technician must enter the hoistway and be on top of the car to service elevator equipment, for example. It is important to ensure adequate clearance between the elevator car and the ends of the hoistway during such a maintenance procedure.

Known systems include placing the controller of the elevator into a service mode, which typically includes a limited range of motion for the elevator car. Electrical safety switches have been proposed as a redundant measure for an event where a control system would not operate correctly during a maintenance procedure.

It is also known to include a physical blocking mechanism such as sliding bolts or moveable columns positioned on top of a car or in an elevator pit that can be manually moved into position to block the car from moving too close to an end of the hoistway.

Previous arrangements have the drawback of requiring additional labor time for the mechanic or service technician to manually move such devices into a position to block movement of the elevator car. It would be beneficial to automate such procedures. Additionally, such arrangements introduce additional materials and expense into the elevator system.

There is a need for an economical and more automated way to insure adequate clearance between an elevator car and the ends of a hoistway. This invention addresses that need.

SUMMARY OF THE INVENTION

An example safety device for use in an elevator system includes a triggering member that is adapted to engage a safety brake associated with an elevator car. An actuator selectively moves the triggering member into a stopping position where the triggering member can engage a safety brake.

In one example, the actuator is electrically activated for selectively moving the triggering member into the stopping position. In one example, the actuator moves the triggering member into the stopping position when the elevator system is placed into an inspection or maintenance mode. In another example, the actuator moves the triggering member into the stopping position responsive to a hoistway access being opened.

An example elevator system includes an elevator car that is vertically moveable along at least one guide rail. At lease one safety brake is supported on the elevator car. The safety brake is adapted to engage the guide rail for preventing vertical movement of the elevator car. A triggering member is supported at a selected height relative to the guide rail. The triggering member is selectively moved into a stopping position where the triggering member triggers the safety brake to engage the guide rail responsive to the elevator car moving into a position near the selected height.

The various features and advantages of this invention will become apparent to those skilled in the art from the following detailed description. The drawings that accompany the detailed description can be briefly described as follows.

DETAILED DESCRIPTION OF THE PREFERRED EMBODIMENT

Figure 1:
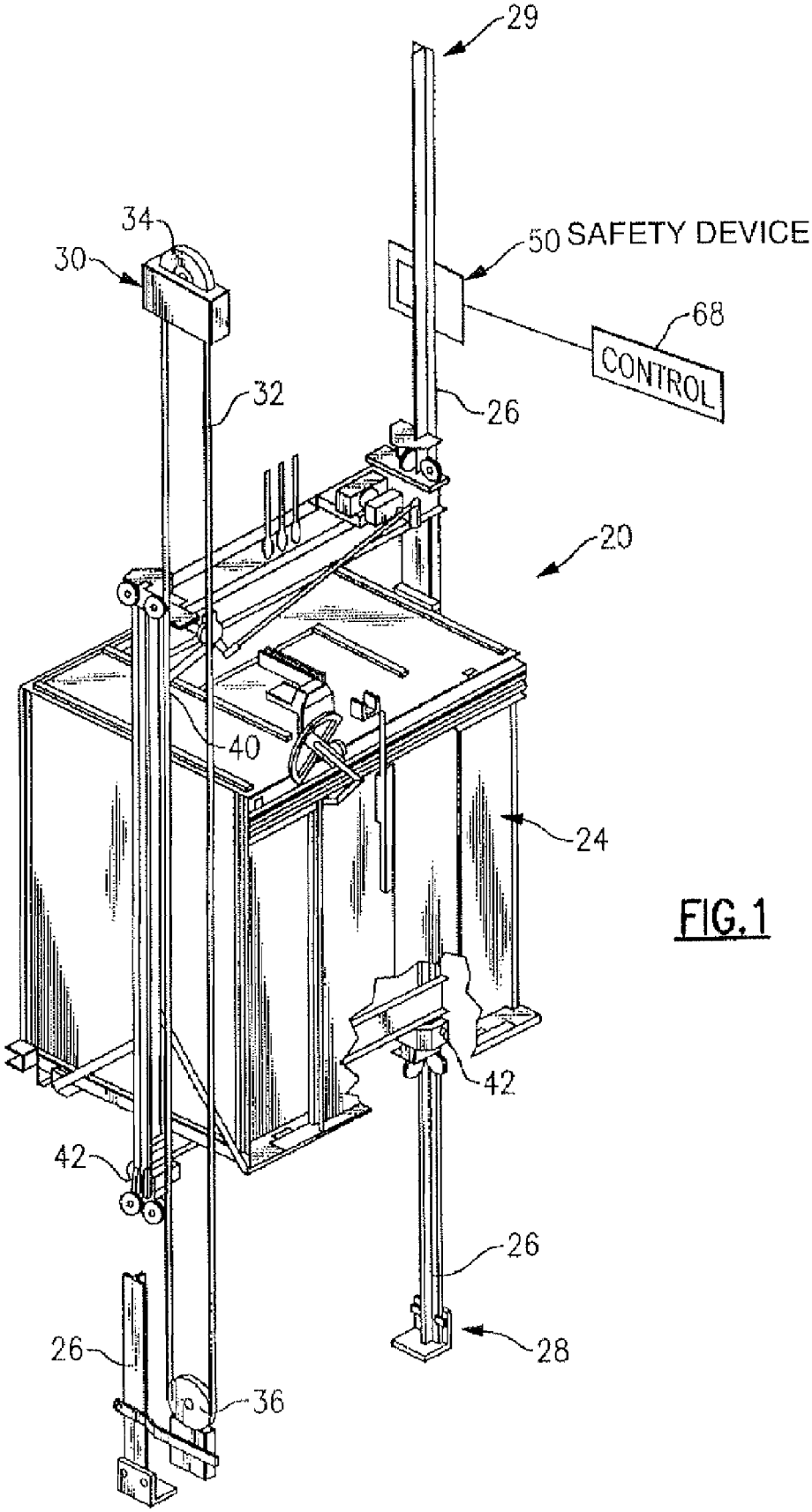
FIG. 1 schematically illustrates selected portions of an elevator system including a safety device designed according to an embodiment of this invention.

FIG. 1 shows an elevator system 20 including an elevator car 24 that moves along guide rails 26 in a known manner. In one example, a machine roomless elevator system allows the car 24 to move essentially along the entire length of a hoistway between a lower end 28 (i.e., a pit) and an upper end 29 of a hoistway. A governor device 30 controls movement of the elevator car 24 by preventing the car from moving beyond a selected maximum speed. The example governor device 30 includes a governor rope 32 that travels with the car 24 as the car moves along the guide rails 26. A governor sheave 34 and a tension sheave 36 are at opposite ends of a loop followed by the governor rope 32.

The illustrated governor device 30 operates in a known manner. In the event that the car 24 moves too fast, the governor device 30 exerts a braking force on the governor sheave 34. That causes the governor rope 32 to pull upon a mechanical linkage 40 to activate safety brakes 42, which in this example apply a braking force against the guide rails 26 to prevent further movement of the elevator car 24. A variety of safety brakes 42 for this purpose are known.

The arrangement of FIG. 1 includes a safety device 50 positioned at a selected height within the hoistway. The safety device 50 interacts with at least one of the safety brakes 42 under selected conditions to prevent the car assembly 24 from moving too close to the upper end 29 of the hoistway, the lower end 28 of the hoistway or both. Only one safety device 50 is schematically shown in FIG. 1 but a plurality of such devices may be strategically placed within a hoistway. Given this description, those skilled in the art will realize how many of such devices are desirable and will be able to select an appropriate location for them to meet the needs of their particular situation.

While the governor device 30 operates depending on a speed of elevator car movement, the safety device 50 operates depending on a vertical position of the elevator car.

Figure 2:
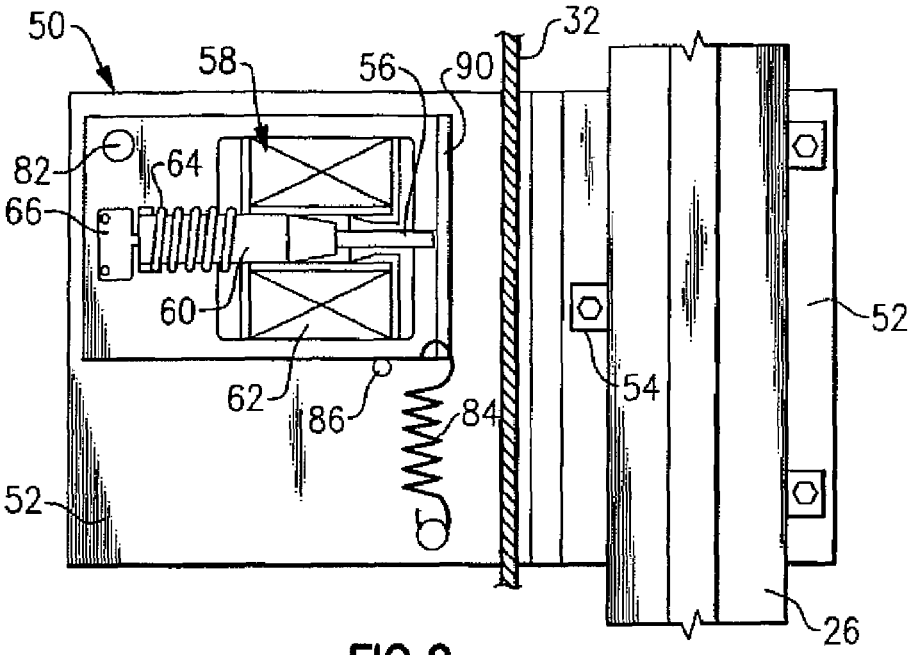
FIG. 2 schematically illustrates an example safety device in a first condition.

An example safety device 50 is shown in FIG. 2. This example includes a mounting plate 52 that is adapted to be secured in a fixed position relative to the guide rails 26. In this example, clips 54 secure the mounting plate 52 to the guide rail 26. The mounting plate 52 may be secured to another stationary structural member or a wall within the hoistway.

Figure 3:
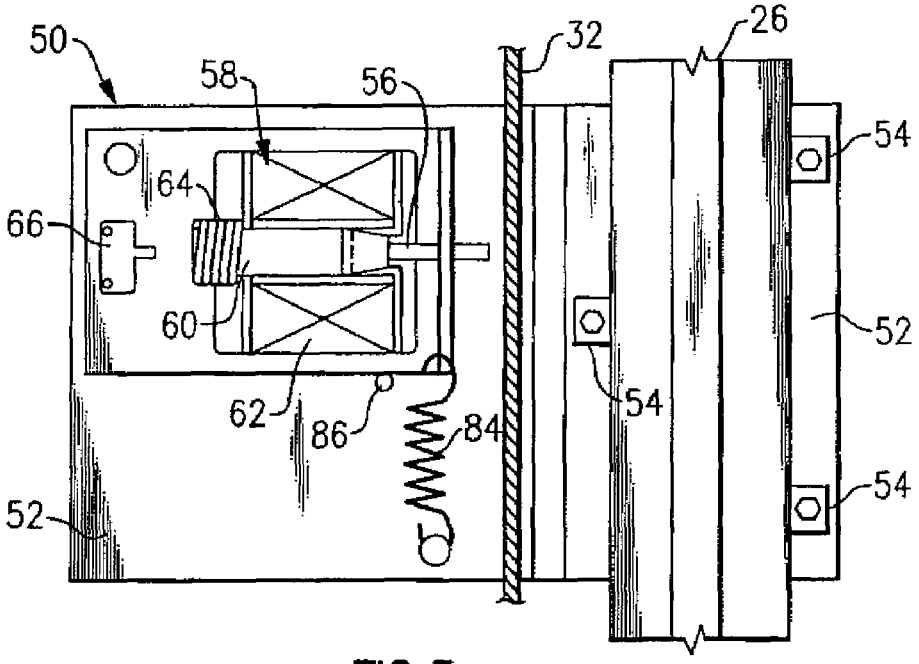
FIG. 3 shows the embodiment of FIG. 2 in another operating condition.

The safety device 50 includes a triggering member 56 that selectively interacts with the safety brakes 42 to prevent movement of the elevator car assembly. 24 beyond a selected range. An actuator 58 causes movement of the triggering member 56 between a retracted position shown in FIG. 2 and a stopping position schematically shown in FIG. 3.

The example actuator 58 includes a magnetic core member 60 and a conductive coil 62. The illustrated example operates effectively like a solenoid device. Current in the coil 62 causes a magnetic field that pulls the magnetic core member 60 in a direction to move toward the stopping position.

In this example, a biasing member 64 biases the magnetic core 60 and the triggering member 56 into the retracted position shown in FIG. 2. In this example, a switch 66 operates responsive to a control 68 (FIG. 1) to energize the coil 62 to cause movement of the triggering member 56 toward the stopping position shown in FIG. 3. When the coil 62 is not energized, the force of the biasing member 64, which in this example is a coiled spring, pulls the triggering member 56 back into the retracted position shown in FIG. 2.

In one example, the control 68 operates the switch 66 and energizes the coil 62 whenever the elevator system is in an inspection mode. This may occur when a technician operates a switch in a known manner to place the elevator system into inspection mode. In another example, the control 68 is responsive to sensors that indicate whenever a hoistway access door is open. Such an arrangement facilitates using the example safety device 50 in situations where a mechanic does not properly place the elevator system into inspection mode, for example. Such an arrangement also provides for operation of the safety device 50 when an unauthorized individual has accessed or attempted to access the hoistway space.

During normal elevator operation, the triggering member 56 is maintained in the retracted position so that the elevator car 24 is free to move along the entire range of the hoistway according to the elevator system design. During an inspection procedure, for example, the triggering member 56 preferably is moved into the stopping position shown schematically in FIG. 3. In this position, the triggering member 56 triggers the safety brakes 42 to stop movement of the elevator car assembly 24 beyond a height, which is dictated by the location of the safety device 50 and the corresponding interaction with the safety brakes 42. Accordingly, the safety device 50 selectively prevents the elevator car from moving beyond a selected position along the guide rails 26. Strategically placing safety devices 50 within an elevator hoistway allows for maintaining adequate clearance between the car assembly 24 and a bottom 28 of a hoistway (i.e., an elevator pit). Similarly, safety devices 50 provide for maintaining a desired clearance between an elevator car 24 and a top 29 of a hoistway.

In another example, the triggering member 56 is biased into the stopping position by the biasing member 64. In such an example, the biasing member 64 urges the triggering member in the opposite direction compared to the previously described example. Energizing the actuator 58 moves the triggering member 56 into the retracted position. Switches strategically placed in the hoistway employ the triggering member as needed based on car position and operating mode. In this example, the mechanical bias ensures that the device will provide a stopping function even if there were a power failure or a problem with the actuator 58, for example. Otherwise, the device works like the illustrated example.

Figure 4:
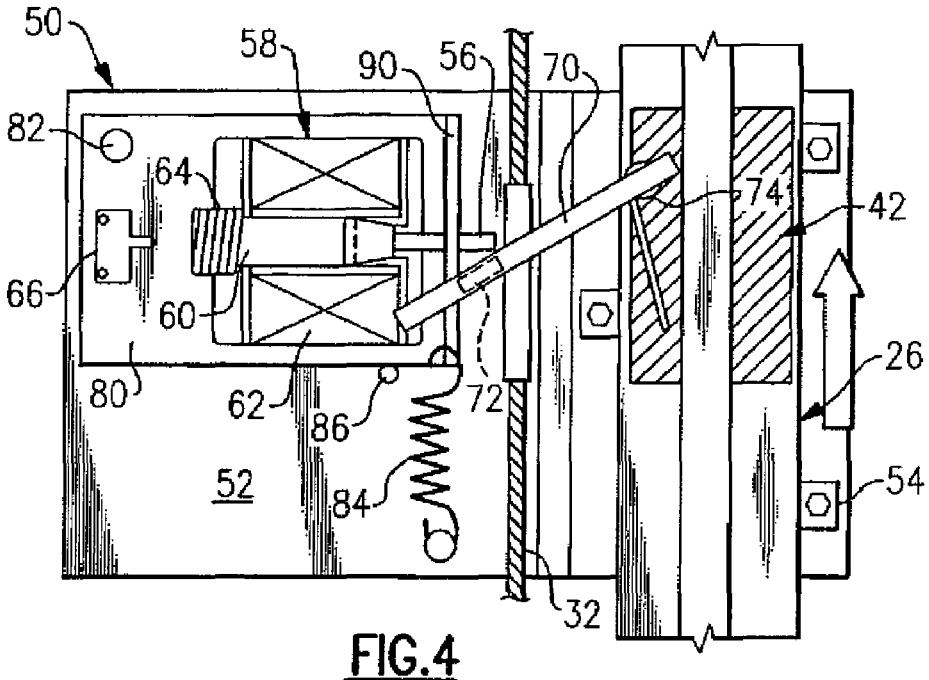
FIG. 4 shows the embodiment of FIG. 2 interacting with an example safety brake.
Figure 5:
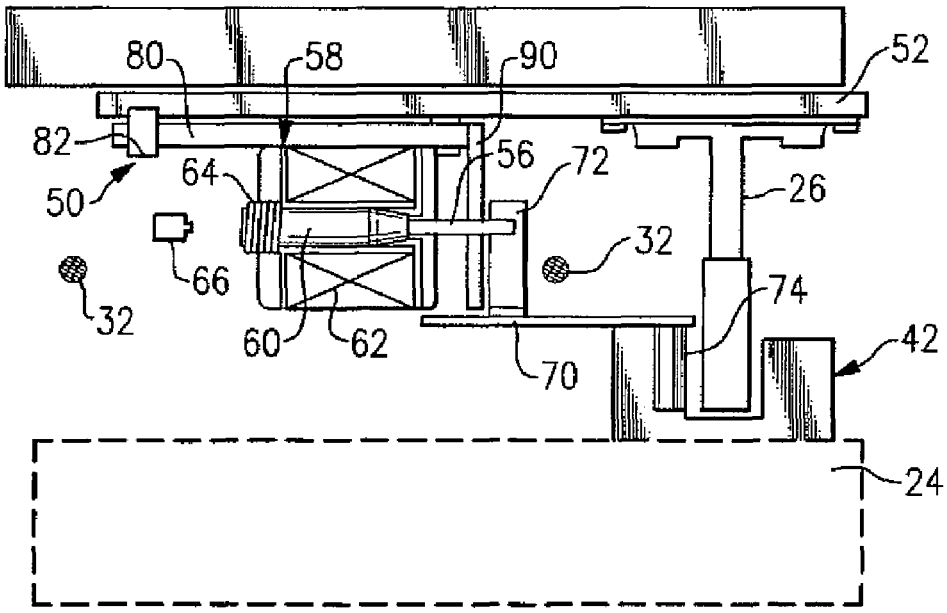
FIG. 5 is another view of the operating condition shown in FIG. 4.

FIGS. 4 and 5 schematically show the safety device 50 at a point of beginning to engage the safety brakes 42. One safety device 50 and one safety brake 42 are shown in FIGS. 4 and 5 for discussion purposes. As the elevator car assembly 24 moves to a position where the triggering member 56 encounters a linkage 70 of the safety brake 42, the triggering member 56 causes the safety brake 42 to move into a braking position. In this example, a contact portion 72 on the linkage 70 makes physical contact with the triggering member 56 in the stopping position. Continued movement of the elevator car (in an upward direction according to FIG. 4) causes movement of the linkage 70 and, therefore, causes a braking member 74 to engage the guide rail 26 to stop further movement of the car.

In one example, the contact portion 72 comprises an angle that is secured to a conventional lever of a safety brake. In another example, the linkage 70 is specifically designed and fabricated to include the contact portion 72.

As can be appreciated from the drawings, when the triggering member 56 is in the stopping position, physical contact between the contact portion 72 and the triggering member 56 becomes possible. When the triggering member 56 is drawn into a retracted position (i.e., FIG. 2), a clearance exists and the triggering member 56 has no effect on the safety brake 42 so that the triggering member 56 does not interfere with normal elevator system operation.

Figure 6:
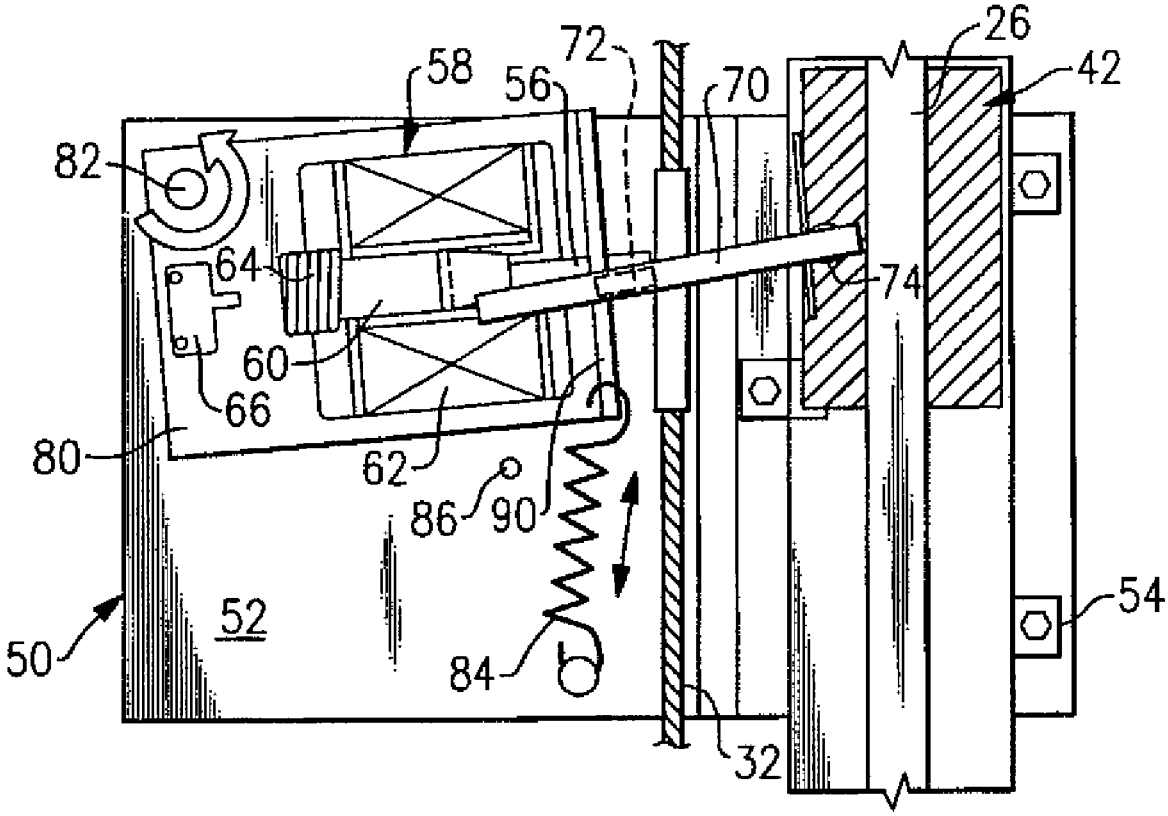
FIG. 6 shows another operating condition of the embodiment of FIG. 2.

FIG. 6 shows another feature of the example embodiment. This example recognizes that the linkage 70 of the safety brake 42 will engage the triggering member 56 when the car is at a first position and that some additional car movement may be required before the safety brake 42 completely engages the guide rail 26 to stop further movement of the car. In this example, the triggering member 56 is supported on a swing plate 80 that pivots about a pivot access 82 relative to the mounting plate 52. Such pivotal movement allows for the triggering member 56 to move with the linkage 70 and the contact portion 72 during engagement of the braking member 74 against the guide rail 26. In this example, the triggering member 56 moves relative to the base plate 52 in a first direction between the retracted and stopping positions and moves in a second, different direction about the pivot axis 82. Such an arrangement prevents damage to the triggering member 56, for example. Further, such an arrangement reduces any possible stress on the actuator 58. In the illustrated example, the actuator 58 is also supported on the swing plate 80 and moves with the triggering member 56 as the swing plate 80 pivots about the pivot access 82.

The illustrated example also includes a control member 84, which is schematically illustrated as a spring. The control member 84 biases the swing plate 80 into a position against a stop 86 that is rigidly supported on the mounting plate 52. The control member 84 allows for some controlled movement of the triggering member 56 in the manner shown by comparing FIG. 4 and FIG. 6, for example.

In one example, the control member 84 has a holding force that holds the swing plate 80 against the stop 86 until the linkage actuation force of the safety brake 42 exceeds the holding force of the control member 84. As the linkage actuation force increases (i.e., the braking member 74 further engages the guide rail 26) the swing plate 80, the triggering member 56 and the actuator 58 pivot about the axis 82 and the triggering member 56 moves with the contact portion 72.

The example swing plate 80 also includes a support member 90 that includes an opening through which the triggering member 56 protrudes when placed in the stopping position. The support member 90 provides additional strength to the arrangement and further insulates the actuator 58 from stress associated with the impact between the triggering member 56 and the contact portion 72 of the linkage 70.

The illustrated example provides the advantage of having an electrically powered and selectively actuated safety device that provides or ensures adequate clearance near an end of a hoistway during an inspection procedure, for example. By strategically placing such safety devices at appropriate heights to interact with a safety brake to activate the safety brake and prevent further movement of the car beyond a selected position provides an economical and fully automated way of ensuring adequate clearance between an elevator car and other structures within a hoistway. The illustrated example has the significant advantage of normally not interfering with elevator system operation.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A safety device for use in an elevator system, comprising:

a triggering member that is moveable into a stopping position such that the triggering member is adapted to contact a safety brake that moves vertically as an elevator car moves relative to the triggering member and approaches a selected vertical position;

an actuator that selectively controls a position of the triggering member; and a base adapted to be supported in a fixed location in an elevator hoistway and wherein the triggering member is supported for movement relative to the base in a first direction for movement into or out of the stopping position and for movement in a second, different direction relative to the base responsive to contact between the triggering member and a brake.

2. The device of claim 1, wherein the actuator is electrically activated for selectively moving the triggering member into a desired position.

3. The device of claim 1, including a biasing member that biases the triggering member into one of a retracted position or the stopping position and wherein the actuator selectively acts against the bias of the biasing member.

4. The device of claim 3, wherein the biasing member comprises a spring.

5. The device of claim 1, wherein the actuator comprises a solenoid.

6. The device of claim 1, wherein the actuator operates such that the triggering member moves into the stopping position when the elevator system is in an inspection mode.

7. The device of claim 1, including a control member that controls movement of the triggering member in the second direction.

8. The device of claim 7, wherein the control member comprises a spring.

9. The device of claim 1, wherein the actuator moves with the triggering member in the second direction.

10. The device of claim 1, wherein the triggering member is supported at a fixed vertical poison in a hoistway.

11. The device of claim 1, wherein the actuator operates such that the triggering member moves into the stopping position when a hoistway access is open.

12. An elevator system, comprising:

an elevator car that is vertically moveable;

at least one safety brake that moves vertically as the elevator car moves, the safety brake selectively preventing vertical movement of the elevator car; and a triggering member that is supported at a selected height and is selectively moveable into a stopping position where the triggering member contacts a portion of the safety brake to prevent vertical movement of the elevator car responsive to the elevator car moving relative to the triggering member into a selected vertical position, wherein the triggering member is moveable in a first direction relative to the base between the stopping and retracted positions and in a second, different direction relative to the base responsive to contact between the triggering member and the safety brake.

13. The system of claim 12, wherein the selected height corresponds to a desired clearance between the elevator car and another surface.

14. The system of claim 12, including a base that is fixed at the selected height and wherein the triggering member is moveable relative to the base between the stopping position and a retracted position.

15. The system of claim 12, wherein the safety brake includes a linkage that is moveable to activate the safety brake and wherein the triggering member physically contacts a portion of the linkage when the elevator car moves into the selected vertical position.

16. The system of claim 15, wherein the portion of the linkage comprises a contact portion that extends generally away from the elevator car and wherein the triggering member is positioned to encounter the contact portion when the triggering member is in the stopping position.

17. The system of claim 12, including an actuator that selectively controls movement of the triggering member into the stopping position.

18. The system of claim 17, wherein the actuator operates responsive to one of the elevator system being in an inspection mode or a hoistway access being open.

19. The system of claim 17, including a biasing member that biases the triggering member into one of the stopping position or a retracted position where the triggering member does not engage the safety brake and wherein the actuator acts against the bias of the biasing member.

20. The system of claim 17, wherein the actuator is electrically activated.

21. A safety device for use iii an elevator system, comprising:

a triggering member that is adapted to engage a safety brake associated with an elevator car as the elevator car approaches a selected vertical position when the triggering member is in a stopping position;

an actuator that selectively controls a position of the triggering member; and a base adapted to be supported in a fixed location in an elevator hoistway and wherein the triggering member is supported on the base for movement relative to the base in a first direction for movement into or out of the stopping position and for movement in a second, different direction relative to the base responsive to contact between the triggering member and a safety brake.

22. The device of claim 21, including a control member that controls movement of the triggering member in the second direction.

23. The device of claim 22, wherein, the control member comprises a spring.

24. The device of claim 21, wherein the actuator moves with the triggering member in the second direction.

25. An elevator system, comprising:

an elevator car that is vertically moveable;

at least one safety brake that moves vertically as the elevator car moves, the safety brake selectively preventing vertical movement of the elevator car;

a triggering member that is supported at a selected height and is selectively moveable into a stopping position where the triggering member triggers the safety brake to prevent vertical movement of the elevator car responsive to the elevator car moving into a selected vertical position; and a base that is fixed at the selected height and wherein the triggering member is moveable relative to the base between the stopping position and a retracted position, wherein the triggering member is moveable in a first direction relative to the base between the stopping and retracted positions and in a second, different direction relative to the base responsive to contact between the triggering member and the safety brake.

* * * * *

UNITED STATES PATENT AND TRADEMARK OFFICE

CERTIFICATE OF CORRECTION

PATENT NO. : 7,650,969 B2
APPLICATION NO. : 11/576273
DATED : January 26, 2010
INVENTOR(S) : Monzon et al.

It is certified that error appears in the above-identified patent and that said Letters Patent is hereby corrected as shown below:

Col. 6, line 33; Claim 21, Line 1, replace "iii" with --in--.

Signed and Sealed this

Twenty-third Day of March, 2010

David J. Kappos

David J. Kappos
*Director of the United States Patent and Trademark Office*